US006250566B1

(12) United States Patent
Jäger

(10) Patent No.: US 6,250,566 B1
(45) Date of Patent: Jun. 26, 2001

(54) ROTOR NOZZLE

(76) Inventor: Anton Jäger, Hofackergasse 3, Senden, 89250 (DE)

( * ) Notice: Subject to any disclaimer, the term of this patent is extended or adjusted under 35 U.S.C. 154(b) by 0 days.

(21) Appl. No.: 09/356,807

(22) Filed: Jul. 20, 1999

(30) Foreign Application Priority Data

Jul. 20, 1998 (DE) ..... 198 32 568

(51) Int. Cl.[7] ..... B05B 3/04

(52) U.S. Cl. ..... 239/237; 239/240; 239/263; 239/264; 239/381

(58) Field of Search ..... 239/227, 237, 239/240, 225.1, 251, 261, 263, 264, 380–383

(56) References Cited

U.S. PATENT DOCUMENTS

| | | | | |
|---|---|---|---|---|
| 4,989,786 | * | 2/1991 | Kranzle et al. | 239/240 |
| 5,328,097 | * | 7/1994 | Wesch et al. | 239/243 |
| 5,332,155 | * | 7/1994 | Jager | 239/240 |
| 5,551,635 | * | 9/1996 | Jager | 239/240 |
| 5,598,975 | * | 2/1997 | Jager | 239/237 |
| 5,722,592 | * | 3/1998 | Jager | 239/227 |
| 5,941,458 | * | 8/1999 | Hartmann | 239/381 |

FOREIGN PATENT DOCUMENTS

| | | |
|---|---|---|
| 4013446C1 | 5/1991 | (DE) . |
| 4133973A1 | 4/1992 | (DE) . |
| 4300599A1 | 2/1994 | (DE) . |
| 4319743A1 | 12/1994 | (DE) . |
| 296 19 572 U1 | 10/1997 | (DE) . |
| 19709120A1 | 9/1998 | (DE) . |
| WO 91/16989 | 11/1991 | (WO) . |

* cited by examiner

*Primary Examiner*—Lisa Ann Douglas
(74) *Attorney, Agent, or Firm*—Townsend and Townsend and Crew LLP

(57) ABSTRACT

The device relates to a rotor nozzle, in particular for high-pressure cleaning apparatus, comprising a nozzle housing which has an inlet opening at its one axial end and an outlet opening for liquid at the other end, also with a rotationally driven rotor arranged in a swirl chamber of the nozzle housing inclined relative to the longitudinal axis of the swirl chamber and supported at the inner wall of the swirl chamber, with the rotor having a nozzle region at its end pointing towards the outlet opening and supported in a cup bearing and an inflow opening at the opposite end, wherein a nozzle member and a distributor member are arranged in the nozzle housing and are rotatable relative to one another, with the distributor member having at least one distributor cutout communicating with the inlet opening, via which functional openings formed in the nozzle member can be controlled, with the functional openings respectively communicating with the swirl chamber or with at least one auxiliary outlet of the nozzle housing.

23 Claims, 3 Drawing Sheets

ROTOR NOZZLE

The present invention relates to a rotor nozzle, in particular for high-pressure cleaning apparatus, comprising a nozzle housing which has an inlet opening at its one axial end and an outlet opening for liquid at the other end, also with a rotationally driven rotor arranged in a swirl chamber of the nozzle housing inclined relative to the longitudinal axis of the swirl chamber and supported at the inner wall of the swirl chamber, with the rotor having a nozzle region at its end pointing towards the outlet opening and supported in a cup bearing and an inflow opening at the opposite end.

Such rotor noble eare basically known and serve to expel a conical liquid jet, in particular at high pressure.

BRIEF SUMMARY OF THE INVENTION

It is the problem (object) underlying the invention to provide a rotor nozzle of the initially named kind, which can be used as universally as possible.

In order to satisfy this object there is provided an apparatus of the initially named kind which is characterized in that a nozzle member and a distributor member are arranged in the nozzle housing and are rotatable relative to one another, with the distributor member having at least one distributor cutout communicating with the inlet opening, via which functional openings formed in the nozzle member can be controlled or selected, with the functional openings respectively communicating with the swirl chamber or with at least one auxiliary outlet of the nozzle housing.

In accordance with the invention, a changeover can be made between a rotational operation, in which the swirl chamber is fed with liquid and at least one additional special jet operation, simply by rotating the nozzle member relative to the distributor member.

In accordance with a preferred embodiment of the invention a plurality of functional openings standing in communication with the auxiliary outlet is provided in the nozzle member and are each formed as a nozzle, in particular as a point jet nozzle, flat jet nozzle or low pressure nozzle.

In this way a rotor nozzle of particularly universal utility is provided in which it is possible to switch between the individual special jet operating types by a simple rotary movement. Since the nozzle member is itself provided with nozzles, no separate nozzle elements are required, whereby the layout of the rotor nozzle is simplified.

In accordance with a further preferred embodiment, the nozzle member and/or the distributor member are made in one piece of ceramic material and preferably manufactured by injection molding.

In this manner the nozzle member and/or the distributor member can be made simply and at comparatively favorable cost, with the manufacture by means of injection molding making it possible to manufacture the special nozzle forms with functional openings in the nozzle member in a particularly simple manner. The use of ceramic material thereby results in particularly low wear components.

In accordance with a further preferred embodiment the nozzle member and the distributor member are arranged in such a way that they contact one another with preferably flat ground side surfaces, which are polished to high gloss.

The contacting regions of the side surfaces take care of the required seal in the region of the distributor cutout and of the respectively selected functional opening, in particular when using ceramic as the material for the nozzle member and the distributor member, so that additional measures for the sealing in these regions can be omitted. Furthermore, limescale deposits, which in any event adhere poorly to ceramic material, else scraped off by the edges of the distributor member bounding the distributor cutout when the distributor member and the nozzle member are rotated relative to one another. The sealing action of the mutually contacting side surfaces is thus preserved even without additional cleaning measures, so that long working lives can be achieved without interruptions caused by cleaning. Furthermore, the provision of such contact surfaces serves for a certain tightness during the mutual rotation of the nozzle member and the distributor member, so that the rotor nozzle cannot adjust automatically. Moreover, the user is given a good feeling during the setting operation, without it being necessary to make the nozzle member and the distributor member so that they latch in the respective functional position.

In accordance with a further preferred embodiment of the invention, provision is made that at least the distributor cutout or the functional openings is or are each surrounded by a sealing bead, which is preferably made in one piece with the nozzle member or the distributor member respectively. Through the provision of such sealing beads, the contact surface between the distributor plate and the nozzle plate is made smaller, whereby the mutual rotation of the nozzle plate and the distributor plate is made easier, but the required seal is nevertheless ensured.

In accordance with a further preferred embodiment of the invention, at least one leakage channel is formed in the side of the nozzle member confronting the distributor member, leads to the functional opening standing in communication with the swirl chamber and communicates with the distributor cutout, at least in an intermediate position of the distributor member.

In this way a particularly simply realized measure is provided for the avoidance of a liquid blockage, which could otherwise arise when the distributor cutout is in an intermediate position between two functional openings.

In accordance with a further preferred embodiment of the invention, the distributor cutout is dimensioned such that it stands in communication with at least one functional opening and/or a leakage channel in every position.

In this connection, in the case of a plurality of functional openings, the provision of a leakage channel between the functional openings can be omitted, since in this region no intermediate positions exist without a possibility of the liquid flowing away.

Further preferred embodiments of the invention are set forth in the subordinate claims, in the description and also in the drawing,

DESCRIPTION OF THE SPECIFIC EMBODIMENTS

Figure 1:
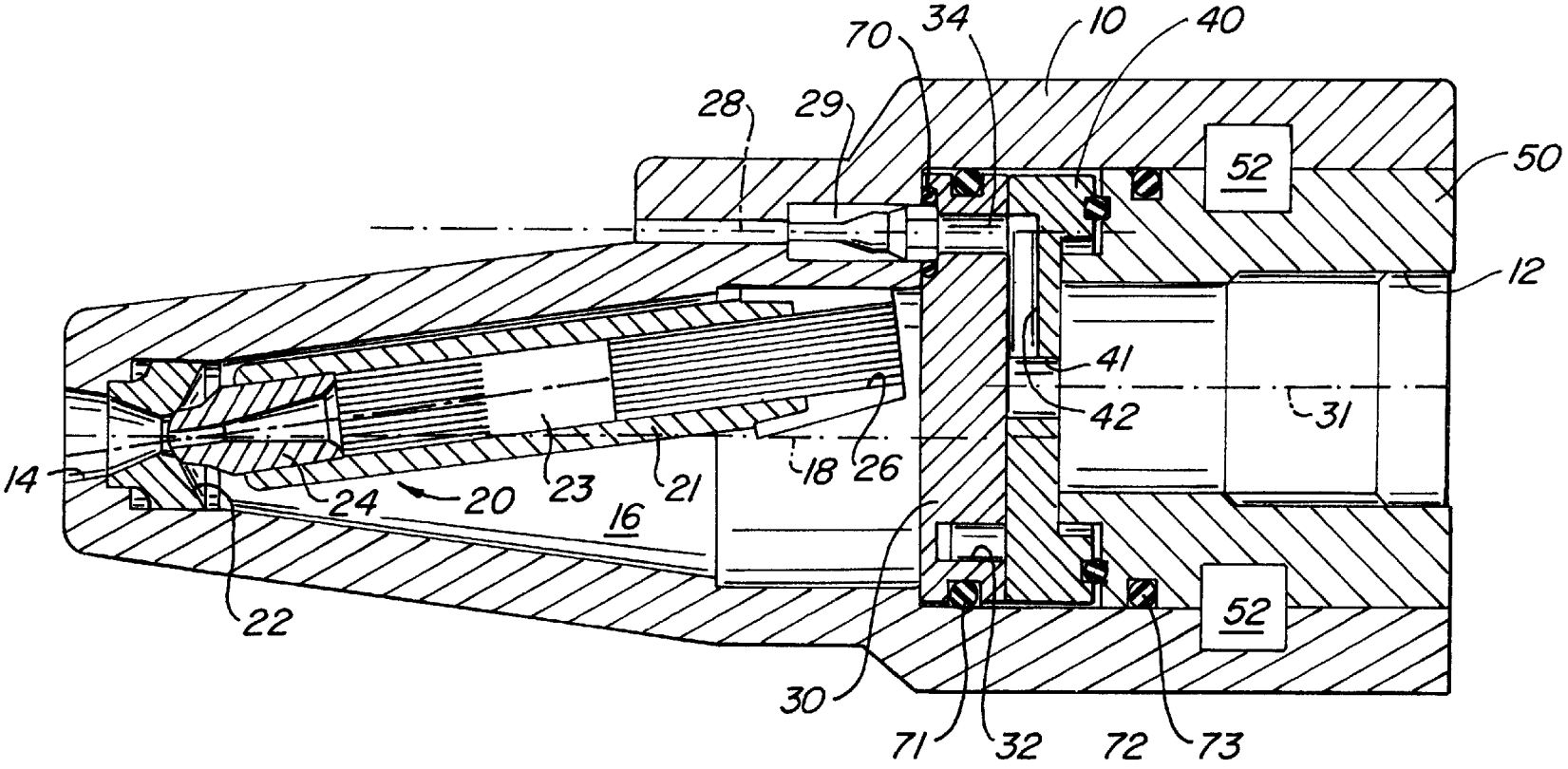
FIG. 1 is an axial section of an embodiment of a rotor nozzle in accordance with the invention.

The rotor nozzle of the invention in accordance with FIG. 1 includes an approximately cylindrical nozzle housing 10 which tapers in the front region and in which a swirl chamber 16 is formed, A rotor 20 is arranged in the swirl chamber 16.

A funnel-like cup bearing 22 for the rotor 20 is arranged in the region of an outlet opening 14 of the nozzle housing 10 and is formed with an inner surface which extends obliquely to the longitudinal axis 18 of the swirl chamber 16.

The rotor 20 includes a cylindrical outer sleeve 21, which, in the front region, includes a nozzle region 24, which is supported during the operation on the cup bearing 22. An inner body 23 of the rotor 20, which has an inflow opening 26 at its end remote from the nozzle region 24, is provided at its inner wall with ribs which serve as a rectifier.

At the connection side, i.e. At the upstream end of the rotor nozzle, a plug 50 serving as a connection piece, is inserted into the nozzle housing 10, with an inlet opening 12 of the rotor nozzle being formed in the plug and with the plug being rotatable relative to the nozzle housing 10.

Cutouts of the outer waHl of the plug 50 and the inner wall of the nozzle housing 10 form, in the assembled state of FIG. 1, insert openings 52 of square cross-section, which extend perpendicular to an axis of rotation 31, which runs parallel to and displaced relative to the longitudinal axis 18 of the swirl chamber 16. A safety yoke not shown in FIG. 1 can be inserted into the insert openings 52 in order to secure the plug 50 so that it cannot move in the. axial direction relative to the nozzle housing 10. The insert openings 52 and the safety yoke are formed in this arrangement in such a way that the free rotatability of the plug 50 relative to the nozzle housing 10 is not impaired.

A switchover arrangement is provided between the downstream end of the inlet opening 12 formed in the plug 50 and the upstream end of the swirl chamber 16 formed in the nozzle housing 10 and includes a distributor member 40, which is rotationally fixedly connected to the plug 50 by suitable means and a nozzle member 30, which can be moved by the nozzle housing 10 and which is in this way rotatable relative to the distributor member 40.

The nozzle member 30 and the distributor member 40 are each formed as a disc of circular cross-section, of which the central axis in each case coincides with the axis of rotation 31 and will be termed nozzle disc and distributor disc respectively in the following.

A central inflow opening 41 which communicates with the inlet opening 12 is formed in the distributor disc 40 and is adjoined by a radially extending distributor cutout 42, termed a distributor passage in the following, which is formed at the side of the distributor disc 40 confronting the nozzle disc 30.

The nozzle disc 30 has, in the embodiment of FIG. 1, two functional openings 32, 34, with the functional opening 32 opening in the tangential direction into the swirl chamber 16 and being closed in the position of FIG. 1 by the side face of the distributor disc 40 confronting the nozzle disc 30.

In the position of FIG. 1 the other functional opening 34 of the nozzle disc 30 produces a flow connection between the distributor channel 42 formed in the distributor disc 40 and a channel-like auxiliary outlet 28 of the nozzle housing 10. An exchangeable nozzle element 29 is inserted into a broadened region of the auxiliary outlet 28 facing the nozzle disc 30 and can, for example, be formed as a point jet nozzle, flat jet nozzle or low pressure nozzle. The nozzle element 29 projects into the functional opening 34, which is broadened in this region and serves in this manner to take the nozzle disc 30 with it when the nozzle housing 10 is rotated relative to the plug 50.

The nozzle disc 30 and the distributor disc 40 are respectively made as one piece components manufactured of ceramic material and are arranged so that their flat ground, mutually confronting side surfaces which are polished to a high gloss contact one another, so that no liquid or only a small quantity of liquid can pass between the two discs 30, 40.

O-rings 70, 71, 72 and 73 take care of the required seal between the individual components.

At the side of the nozzle disc 30 adjacent the distributor disc 40 a leakage channel is formed which leads to the functional opening 32, which cannot be recognized in FIG. 1, and the purpose of which will be explained in more detail with reference to the embodiment of FIG. 2.

In the operation of the rotor nozzle of the invention in accordance with FIG. 1, liquid, in particular water, flows under high pressure into the inlet opening 12 and via the inflow opening 41 of the distributor disc 40 into the distributor passage 42. From the distributor passage 42 the liquid flows through the functional opening 34 of the nozzle disc 30 and through the nozzle element 29 arranged in the auxiliary outlet 28, whereupon it emerges from the nozzle housing 10.

The jet shape of the emerging liquid jet is determined in this arrangement by the respective nozzle element 29. A rotational operation does not occur in the position of FIG. 1, since the functional opening 32 which opens into the swirl chamber 16 is closed by the distributor disc 40.

In order to change over from the jet operation of FIG. 1 to rotational operation, the nozzle housing 10 is rotated relative to the plug 50, whereby the functional opening 32 of the nozzle disc 30, which is moved on by the nozzle housing 10 and which opens into the swirl chamber 16, is connected to the distributor passage 42. The liquid can then flow into the swirl chamber 16 in the tangential direction, in which it sets the rotor 20 turning by swirl formation and flows through the inflow opening 26 into the rotor 20 and finally out of the outlet opening 14 of the nozzle housing 10, which follows the nozzle region 24. By means of the rotor, which is driven in rotation in this manner and which is supported with the nozzle region 24 on the cup bearing 24 and with the outer sleeve 21 on the inner wall of the swirl chamber 16, a conical liquid jet is expelled from the rotor nozzle.

In an intermediate position in which the distributor passage 42 does not directly serve any of the functional openings 32, 34, the distributor passage 42 communicates with the leakage passage not shown in FIG. 1, but which leads to the functional opening 32, so that no liquid blockage arises, but rather the liquid can already flow at the start of rotation functional opening the distributor passage 42 away from the functional opening 34 via the leakage passage to the functional opening 32 and via the latter into the swirl chamber 16.

As an alternative to the above described embodiment of the rotor nozzle of the invention, a plurality of auxiliary outlets distributed in the circumferential direction can also be formed in the nozzle housing 10, with each auxiliary outlet standing in communication with an associated functional opening of the nozzle disc 30 and with it being possible to selectively operate each auxiliary outlet by means of the distributor passage 42 by rotation of the distributor disc 40 relative to the nozzle disc 30. Each auxiliary outlet is in this case provided with a nozzle element which produces a special jet shape.

A preferred embodiment of a rotor nozzle in accordance with the invention which differs from the embodiment described in FIG. 1 essentially in the design of the nozzle disc 30 will be described in the following with reference to FIG. 2.

Figure 2:
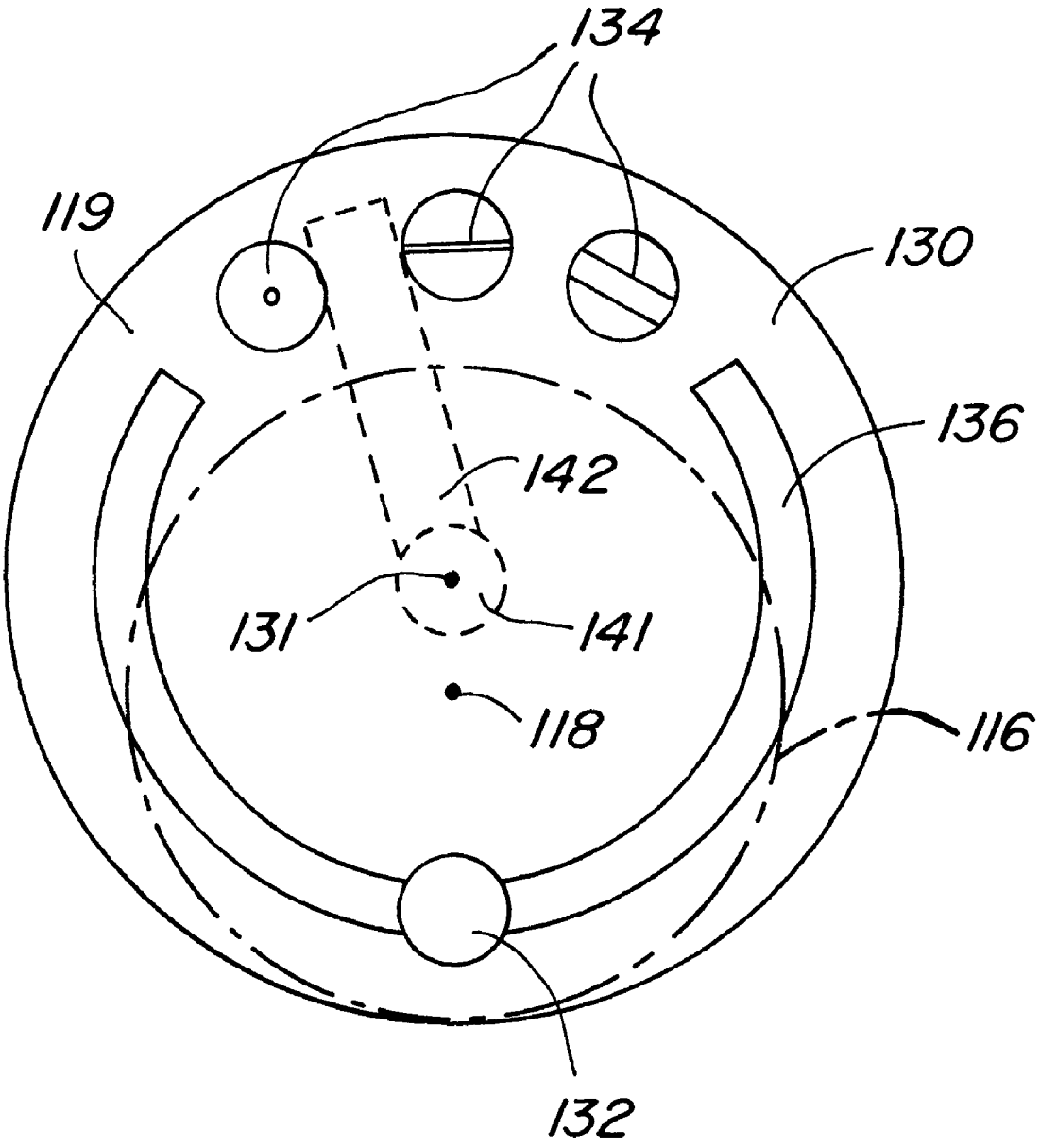
FIG. 2 is a plan view of the side of the nozzle member confronting the distributor member in accordance with a further embodiment of the invention.

In accordance with FIG. 2, the one piece nozzle disc 130, which is likewise manufactured of ceramic material by injection molding, is provided with three functional openings 134, which are not formed as simple passage openings of circular cross-section, but rather as a nozzle which in each case produces a special jet shape, namely as a point jet nozzle, as a flat jet nozzle or as a low pressure nozzle having a rectangular cross-section, as shown in FIG. 2. Basically, the functional openings 134 of the nozzle disc 130 can have any desired nozzle shape.

The auxiliary outlet of the nozzle housing, which is not shown, but which corresponds to such a nozzle disc 130, can be formed as a slit which extends at least across the angular range preset by the functional opening 134. The liquid jet formed through the slit as a point jet, as a flat jet or as a low pressure jet can emerge undisturbed from the nozzle housing. A separate auxiliary outlet can, however, also be provided for each functional opening 134.

In the nozzle disc 130 a leakage passage 136 is formed which has two arms which respectively extend from the functional opening 132 opening into the swirl chamber 116 in the direction of the outer functional opening 134 and terminate shortly before the latter.

The distributor passage 142 formed in the distributor disc, which is indicated by broken lines in FIG. 2 and adjoins the inflow opening 141 of the nozzle disc, which is likewise shown in broken lines, is measured such that it communicates in every angular position either with one of the functional openings 134 or with the leakage passage 136.

In order to reduce the frictional surface effective between the nozzle disc 130 and the distributor disc raised portions in the form of rib-like sealing beads and/or small support projections can either be provided on the nozzle disc 130 or on the distributor disc and can be formed simultaneously with the production of the nozzle disc 130 or of the distributor disc by injection molding, with the surface facing the other respective disc being ground flat and in particular lapped flat.

By way of example, the distributor disc can be provided at its surface facing the nozzle disc 130 with a sealing bead which surrounds the distributor passage 42 and with support projections which are arranged in distributed manner. Alternatively, the nozzle disc 130 can be provided with a sealing bead which extends around the nozzle disc close to the rim of the nozzle disc 130.

In FIG. 2 the swirl chamber 116, which is covered by the nozzle disc 130, is indicated by a chain dotted line and has a smaller diameter than the nozzle disc 130. The functional opening 132 of the nozzle disc 130 opens into the swirl chamber 116.

The longitudinal axis 118 of the swirl chamber 116 is arranged parallel to and displaced relative to the axis of rotation 131 of the nozzle disc 130 opens into the swirl chamber 116.

The longitudinal axis 118 of the swirl chamber 116 is arranged parallel to and displaced relative to the axis of rotation 131 of the nozzle disc 130 and of the distributor disc, so that a scythe-shaped or half-moon-shaped region 119 is present, which is available for the functional openings 134.

It is of advantage that, on the one hand, the nozzle housing only needs to be radially enlarged in the region of the auxiliary outlet or auxiliary outlets which communicated with the functional openings 134, so that the rotor nozzle can be made comparatively slender despite a large functional diversity. On the other hand, the functional opening 132 which opens into the swirl chamber 116 is arranged relatively far outwardly in the radial direction with respect to the longitudinal axis 118 of the swirl chamber 116, whereby a good swirl formation and thus high speeds of rotation of the rotor are ensured.

The geometry shown in FIG. 2 and the above explanations apply in corresponding manner for the embodiment of the rotor nozzle of the invention of FIG. 1.

In an alternative embodiment the rotational axis 31, 131 and the longitudinal axis 18, 118 could coincide with a simultaneously enlarged nozzle disc 30, 130. This would be advantageous in that the functional openings 34, 134 could be arranged distributed over 360° and indeed radially outside of the functional opening 32, 132 opening into the swirl chamber 116.

Furthermore, the nozzle disc 30, 130 and the distributor disc 40 could also consist of brass, plastic, steel or rubber. Ceramic is, however, preferred because sand grains which then enter between the nozzle disc 30, 130 and the distributor disc 40 cannot scratch their surfaces. Moreover, limescale deposits which in any case adhere poorly to the ceramic material, are easily screlpcd off by the edges, which bound the distributor passage of the distributor disc when thc nozzle disc and the distributor disc are rotated relative to one another.

Figure 3:
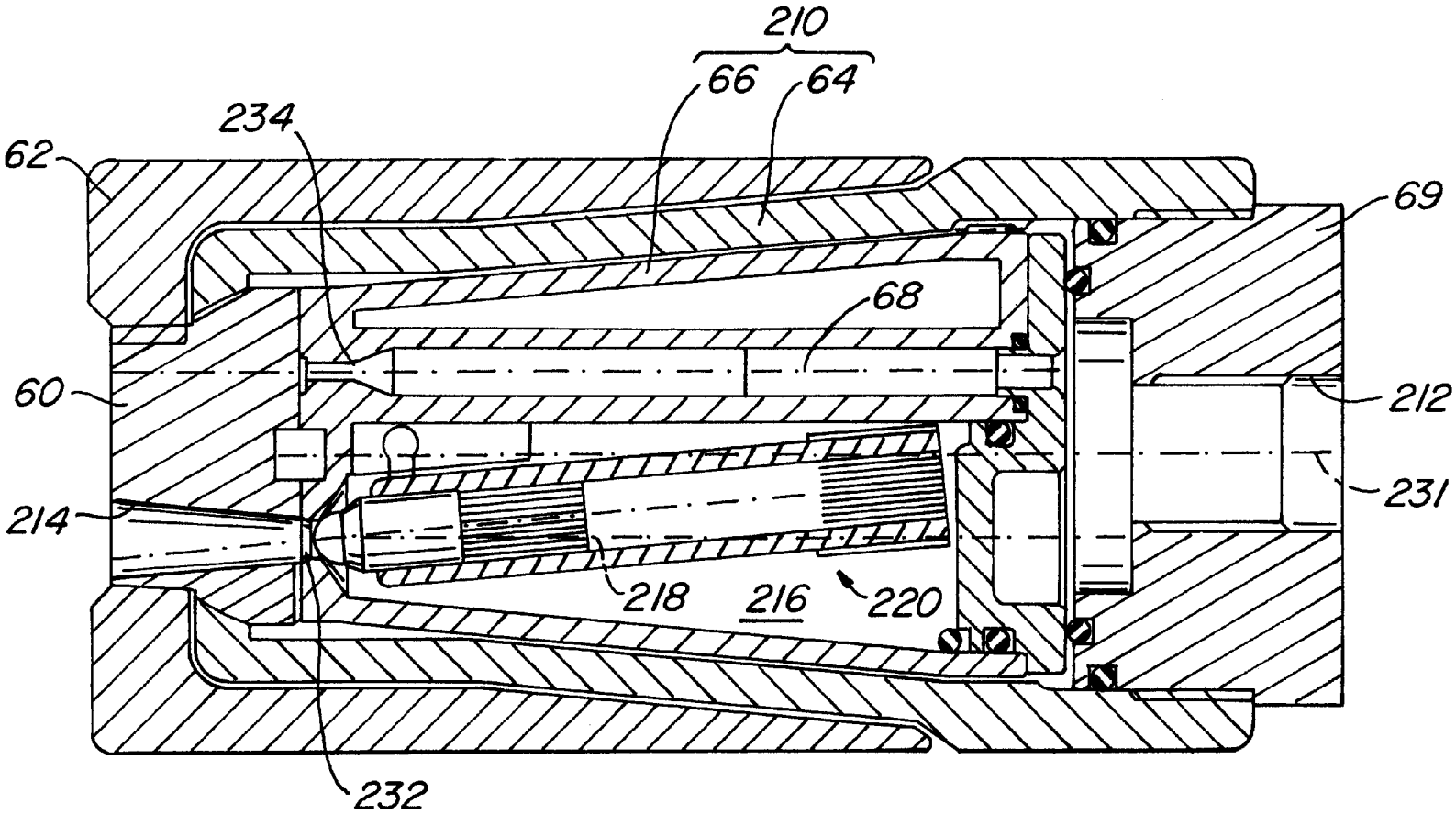
FIG. 3 is an axial section of a further embodiment of a rotor nozzle in accordance with the invention.

In the embodiment of a rotor nozzle in accordance with the invention, as shown in FIG. 3, the outlet opening 214 is formed in a positioning member 60, which can be turned relative to the nozzle housing 210 via a sleeve 62.

The nozzle housing 210 includes an outer jacket 64 and an inner body 66 preferably manufactured of ceramic material in which a swirl chamber 216 for a rotor 220 is formed, which corresponds essentially to the rotor described with reference to FIG. 1 and is supported at the opening 232 of the swirl chamber 216. The longitudinal axs 218 of the swirl chamber 216 extends parallel to but displaced relative to an axis of rotation 231, about which the setting member 60 and the nozzle housing 210 can be rotated relative to one another.

Furthermore, at least one auxiliary chamber 68 is formed in the inner body 66, with the front region of the auxiliary chamber being formed as a nozzle, for example as a point jet nozzle, as a flat jet nozzle or as a low pressure nozzle. A plurality of auxiliary chambers arranged in a distributed manner in the circumferential direction and provided with nozzle regions producing different jet shapcs arc prefcrably provided.

The auxiliary chamber 68 and also the swirl chamber 216 are simultaneously connectable to a liquid source via an inlet opening 212 formed in a plug 69, with the outlet opening 214 formed in the positioning member 60 communicating in the position of FIG. 3 with the swirl chamber 216 and thus enabling a rotational operation.

In order to change over into a jet operation, the positioning member 60 is rotated by means of the sleeve 62 relative to the nozzle housing 210 until the outlet opening 214 is coupled to the auxiliary chamber 68, which produces the desired jet shape via a nozzle element 234.

The nozzle housing, or the respective connection member, can be provided in all embodiments of the rotor nozzle of the invention with suitable symbols which indicate to the user the respectively selected jet shape.

What is claimed is:

1. A rotor nozzle comprising:

a nozzle housing having an inlet opening at an axial end thereof and an outlet opening for liquid at another end thereof, the nozzle housing including a swirl chamber having a longitudinal axis and an inner wall;

a rotationally driven rotor disposed in the swirl chamber, the rotor being inclined relative to the longitudinal axis of the swirl chamber and supported at the inner wall of the swirl chamber, the rotor having a nozzle region at a first end pointing towards the outlet opening of the nozzle housing and supported in a cup bearing provided at the outlet opening, the rotor having an inflow opening at a second end opposite from the first end; and a nozzle member and a distributor member disposed in the nozzle housing and being rotatable relative to one another, the distributor member having at least one distributor cutout communicating with the inlet opening of the nozzle housing, via the at least one distributor cutout a plurality of functional openings formed in the nozzle member are controllable, the functional openings each respectively communicating with the swirl chamber or with at least one auxiliary outlet in the nozzle housing, separate nozzle elements being insertable into the auxiliary outlet.

2. A rotor nozzle comprising:

a nozzle housing having an inlet opening at an axial end thereof and an outlet opening for liquid at another end thereof, the nozzle housing including a swirl chamber having a longitudinal axis and an inner wall;

a rotationally driven rotor disposed in the swirl chamber, the rotor being inclined relative to the longitudinal axis of the swirl chamber and supported at the inner wall of the swirl chamber, the rotor having a nozzle region at a first end pointing towards the outlet opening of the nozzle housing and supported in a cup bearing provided at the outlet opening, the rotor having an inflow opening at a second end opposite from the first end; and a nozzle member and a distributor member disposed in the nozzle housing and being rotatable relative to one another, the distributor member having at least one distributor cutout communicating with the inlet opening of the nozzle housing, via the at least one distributor cutout a plurality of functional openings formed in the nozzle member are controllable, the functional openings each respectively communicating with the swirl chamber or with at least one auxiliary outlet in the nozzle housing, at least one leakage channel being formed in a side of the nozzle member facing the distributor member, the leakage channel leading to a function opening in the nozzle member standing in communication with the swirl chamber and communicating with the distributor cutout at least in an intermediate position of the distributor member in which the distributor cutout does not directly couple to any of the functional openings of the nozzle member.

3. A rotor nozzle comprising:

a nozzle housing having an inlet opening at an axial end thereof and an outlet opening for liquid at another end thereof, the nozzle housing including a swirl chamber having a longitudinal axis and an inner wall, the nozzle housing including a plug rotationally fixed relative to the nozzle housing, the inlet opening being formed in the plug;

a rotationally driven rotor disposed in the swirl chamber, the rotor being inclined relative to the longitudinal axis of the swirl chamber and supported at the inner wall of the swirl chamber, the rotor having a nozzle region at a first end pointing towards the outlet opening of the nozzle housing and supported in a cup bearing provided at the outlet opening, the rotor having an inflow opening at a second end opposite from the first end; and a nozzle member and a distributor member disposed in the nozzle housing and being rotatable relative to one another, the distributor member having at least one distributor cutout communicating with the inlet opening of the nozzle housing, via the at least one distributor cutout a plurality of functional openings formed in the nozzle member are controllable, the functional openings each respectively communicating with the swirl chamber or with at least one auxiliary outlet in the nozzle housing.

4. The rotor nozzle of claim 3 wherein the distributor member is rotationally fixedly connected to the plug and the nozzle member is rotationally fixedly connected to the nozzle housing.

5. A rotor nozzle comprising:

a nozzle housing having an inlet opening at an axial end thereof and an outlet opening for liquid at another end thereof, the nozzle housing including a swirl chamber having a longitudinal axis and an inner wall;

a rotationally driven rotor disposed in the swirl chamber, the rotor being inclined relative to the longitudinal axis of the swirl chamber and supported at the inner wall of the swirl chamber, the rotor having a nozzle region at a first end pointing towards the outlet opening of the nozzle housing and supported in a cup bearing provided at the outlet opening, the rotor having an inflow opening at a second end opposite from the first end; and a nozzle member and a distributor member disposed in the nozzle housing and being rotatable relative to one another, the distributor member having at least one distributor cutout communicating with the inlet opening of the nozzle housing, via the at least one distributor cutout a plurality of finctional openings formed in the nozzle member are controllable, the finctional openings each respectively communicating with the swirl chamber or with at least one auxiliary outlet in the nozzle housing, the nozzle member and distributor member contacting one another with flat ground side surfaces polished to a high gloss.

6. A rotor nozzle comprising:

a nozzle housing having an inlet opening at an axial end thereof and an outlet opening for liquid at another end thereof, the nozzle housing including a swirl chamber having a longitudinal axis and an inner wall;

a rotationally driven rotor disposed in the swirl chamber, the rotor being inclined relative to the longitudinal axis of the swirl chamber and supported at the inner wall of the swirl chamber, the rotor having a nozzle region at a first end pointing towards the outlet opening of the nozzle housing and supported in a cup bearing provided at the outlet opening, the rotor having an inflow opening at a second end opposite from the first end; and a nozzle member and a distributor member disposed in the nozzle housing, the distributor member including at least one distributor cutout communicating with the inlet opening of the nozzle housing, the nozzle member including a plurality of functional openings each respectively communicating with the swirl chamber or with at least one auxiliary outlet in the nozzle housing, the swirl chamber communicating with the outlet opening of the nozzle housing, the nozzle member and the distributor member being rotatable relative to one another to adjust communication between the at least one distributor cutout of the distributor member and the plurality of functional openings of the nozzle member to change a flow from the inlet opening of the nozzle housing to the outlet opening and the at least one auxiliary outlet of the nozzle housing.

7. The rotor nozzle of claim 6 wherein the nozzle member and the distributor member are each formed as a disc or plate with a circular cross-section.

8. The rotor nozzle of claim 6 wherein the nozzle member includes a plurality of functional openings which stand in communication with the auxiliary outlet of the nozzle housing and which are each formed as a nuzle.

9. The rotor nozzle of claim 8 wherein the plurality of functional openings include a point jet nozzle, a flat jet nozzle, and a low pressure nozzle.

10. The rotor nozzle of claim 6 wherein separate nozzle elements are insertable into the auxiliary outlet of the nozzle housing.

11. The rotor nozzle of claim 6 wherein the functional openings which stand in communication with the auxiliary outlet of the nozzle housing are distributed on a circle about an axis of rotation of the nozzle member and of the distributor member.

12. The rotor nozzle of claim 6 wherein an axis of rotation of the nozzle member and the distributor member is parallel to and displaced relative to the longitudinal axis of the swirl chamber.

13. The rotor nozzle of claim 6 wherein at least one of the nozzle member and the distributor member is made in one piece of ceramic.

14. The rotor nozzle of claim 13 wherein at least one of the nozzle member and the distributor member is manufactured by injection molding.

15. The rotor nozzle of claim 10 wherein the nozzle member and the distributor member contact one another with flat ground side surfaces.

16. The rotor nozzle of claim 15 wherein the flat ground side surfaces are polished to a high gloss.

17. The rotor nozzle of claim 6 wherein at least one of the distributor cutout and the finctional openings of the nozzle member is surrounded by a sealing bead.

18. The rotor nozzle of claim 17 wherein the sealing bead is made in one piece with at least one of the nozzle member and the distributor member, respectively.

19. The rotor nozzle of claim 6 wherein at least one leakage channel is formed in a side of the nozzle member facing the distributor member, the leakage channel leading to one of the functional openings in the nozzle member standing in communication with the swirl chamber and communicating with the distributor cutout at least in an intermediate position of the distributor member in which the distributor cutout does not directly couple to any of the functional openings of the nozzle member.

20. The rotor nozzle of claim 19 wherein the distributor cutout is dimensioned such that in each position the distributor cutout stands in communication with at least one functional opening of the nozzle member or with a leakage channel.

21. The rotor nozzle of claim 6 wherein the nozzle housing includes a plug rotationally fixed relative to the nozzle housing, the inlet opening being formed in the plug.

22. The rotor nozzle of claim 21 wherein the distributor member is rotationally fixedly connected to the plug and the nozzle member is rotationally fixedly connected to the uozzle housing.

23. A rotor nozzle comprising:

a nozzle housing having an inlet opening at an axial end thereof and an outlet opening for liquid at another end thereof, the nozzle housing including a swirl chamber having a longitudinal axis and an inner wall, the nozzle housing including a plurality of functional openings distributed in a circumferential direction, at least one functional opening communicating with the swirl chamber and at least one functional opening being formed as a nozzle;

a rotationally driven rotor disposed in the swirl chamber, the rotor being inclined relative to the longitudinal axis of the swirl chamber and supported at the inner wall of the swirl chamber, the rotor having a nozzle region at a first end pointing towards the outlet opening of the nozzle housing and supported in a cup bearing provided at the outlet opening, the rotor having an inflow opening at a second end opposite from the first end; and a positioning member disposed at an outlet end of the nozzle housing and forming the outlet opening of the nozzle housing, the positioning member being rotatable relative to the nozzle housing to adjust communication between the outlet opening and the fuictional openings of the nozzle housing to change a flow from the inlet opening of the nozzle housing to the outlet opening.

* * * * *